US006430798B1

(12) United States Patent
Ru

(10) Patent No.: US 6,430,798 B1
(45) Date of Patent: Aug. 13, 2002

(54) METHOD FOR MANUFACTURING A ZIPPER

(76) Inventor: Chih-Wen Ru, No. 12, Lane 524, Sec 3rd Sha Tien Rd., Ta Tu Hsiang, Taichung Hsien (TW)

( * ) Notice: Subject to any disclaimer, the term of this patent is extended or adjusted under 35 U.S.C. 154(b) by 0 days.

(21) Appl. No.: 09/899,115

(22) Filed: Jul. 6, 2001

(51) Int. Cl.[7] ..... B29D 5/00
(52) U.S. Cl. ..... 29/408; 29/766; 29/33.2
(58) Field of Search ..... 29/408, 766, 33.2

(56) References Cited

U.S. PATENT DOCUMENTS 4,596,065 A * 6/1986 Tanikawa et al. ..... 29/408
4,704,781 A * 11/1987 Frolich ..... 29/408

* cited by examiner

*Primary Examiner*—P. W. Echols
(74) *Attorney, Agent, or Firm*—Rosenberg, Klein & Lee

(57) ABSTRACT

A method for manufacturing a zipper includes the step of dividing a label into two halves. The two halves are disposed on a cloth strip. Two banks of continuous chain teeth are pressed against one another and then are sewn to the cloth strip. The width between the sewing portion of two banks is equal to the distance between the two halves of the label. A wedge block expands the two banks of chain teeth outwards, so that a space is formed. The cloth strip is melted and cut, so that the cloth strip is cut adjacent to the two chain teeth. A strip separation wheel feeds out the left and right portions of the cloth strip, sewn with the chain teeth, at the same time. Fittings, such as a chain clip, are attached to the chain teeth to finish the zipper.

2 Claims, 8 Drawing Sheets

METHOD FOR MANUFACTURING A ZIPPER

FIELD OF THE INVENTION

The present invention relates to a method for manufacturing a zipper, wherein a pattern for character label is divided into two portions which are conformable and distanced with a gap, and the two portions are manufactured on a cloth strip. After sewing two banks of chain teeth to the cloth strip, the two halves of the label closely press against one another to form a hidden type zipper.

BACKGROUND OF THE INVENTION

In general, in the method for manufacturing a hidden type zipper with patterns, two labels are arranged on two continuous cloth strips, and the patterns oil the two labels are matched with one another. The two strips are sent to a sewing machine for chain teeth. Then, optic sensors are used to check whether the two labels are aligned. If not, transfer rollers are used to guide the labels to be aligned and matched to one another, However, in the aforesaid method, the two labels arc separately arranged on two continuous cloth strips. Therefore, it is very possible that an error in alignment occurs, so that the two patterns on the labels cannot be matched.

SUMMARY OF THE INVENTION

Accordingly, the primary object of the present invention is to provide a, method for manufacturing a zipper, wherein a pattern or character label is divided into two halves The two halves are disposed on the cloth strip. The width at the sewing, portion of two banks of chain teeth is equal to the distance between the two halves of the label. The cloth strip is melted and cut so that the cloth strip is cut adjacent to the two banks of chain teeth. A strip separation wheel feeds out two portions sewn with chain teeth of the cloth strip at the same time. Then a fitting, such as a chain clip, is attached thereto. As a result, the zipper is finished.

Another object of the present invention is to provide a method for manufacturing a zipper, wherein two cutting portions press into the cloth strip to pass to a supersonic vibrating table. Thereby, the cloth strip can be melted and cut by supersonic waves. As the cloth strip is melted and cut by supersonic waves, the inclined portions of the cutting portion press against the cloth strip. Thereby, the edges of the left and right portions of the cut cloth strip 1 are well scaled.

The various objects and advantages of the present invention will be more readily understood from the following detailed description when read in conjunction with the appended drawings.

DETAILED DESCRIPTION OF THE INVENTION

In order that those skilled in the art can further understand the present invention, a detailed description will be provided in the following paragraphs. However these descriptions and the appended drawings are only used to cause those skilled in the art to understand the objects, features, and characteristics of the present invention, but not to be used to confine the scope and spirit of the present invention defined in the appended claims.

With reference to FIGS. 1 to 8, the method for manufacturing a zipper of the present invention is illustrated. The method comprises the following steps.

Step 1: Manufacturing strips

Figure 1:
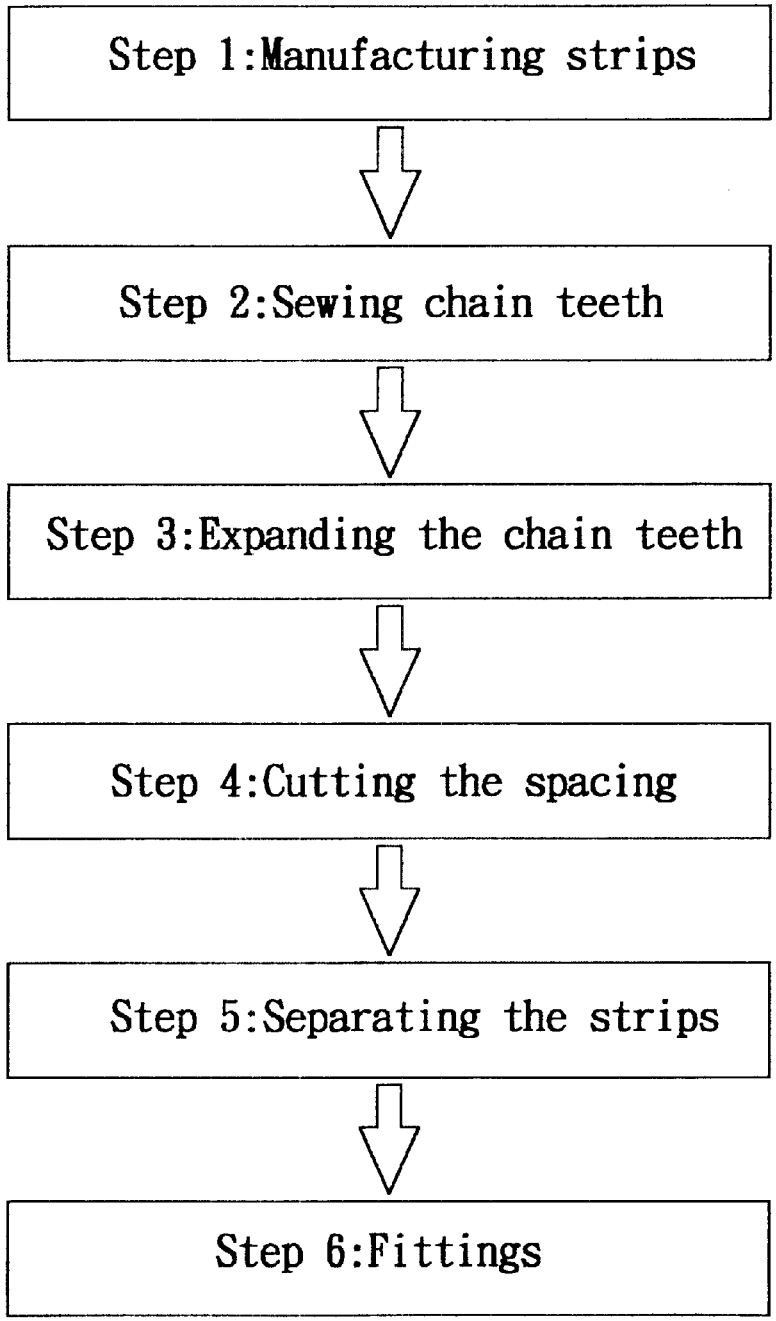
FIG. 1 is a flow diagram of the present invention.
Figure 2:
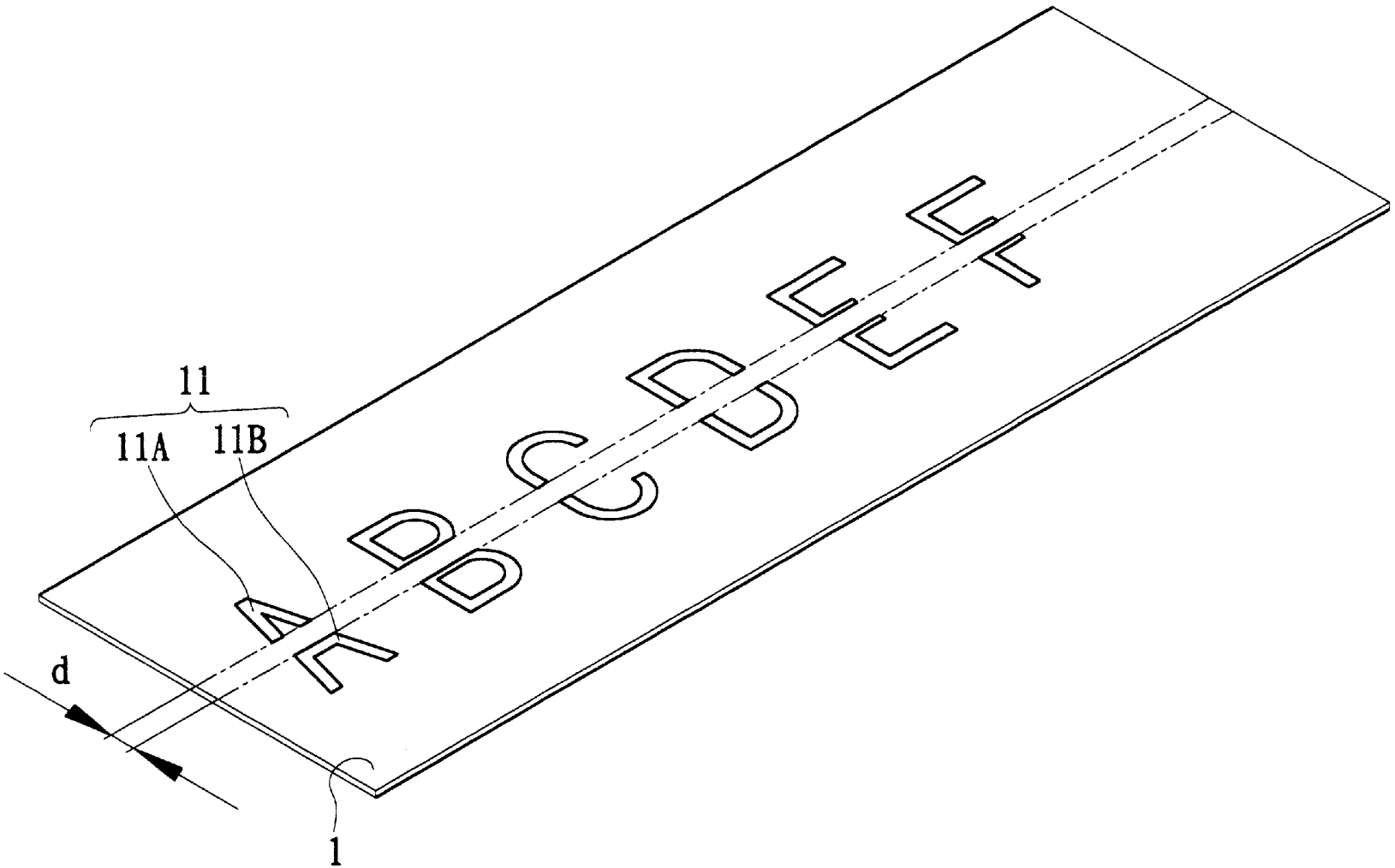
FIG. 2 is a schematic view showing two portions of the label of the present invention arranged separately.

In a cloth strip 1, the pattern or character label 11 is divided into two halves 11A and 11B. The two halves 11A and 11B are spaced with a distance d so as to be formed on the cloth strip 1, as shown in FIG. 2.

Step 2: Sewing chain teeth

Figure 3:
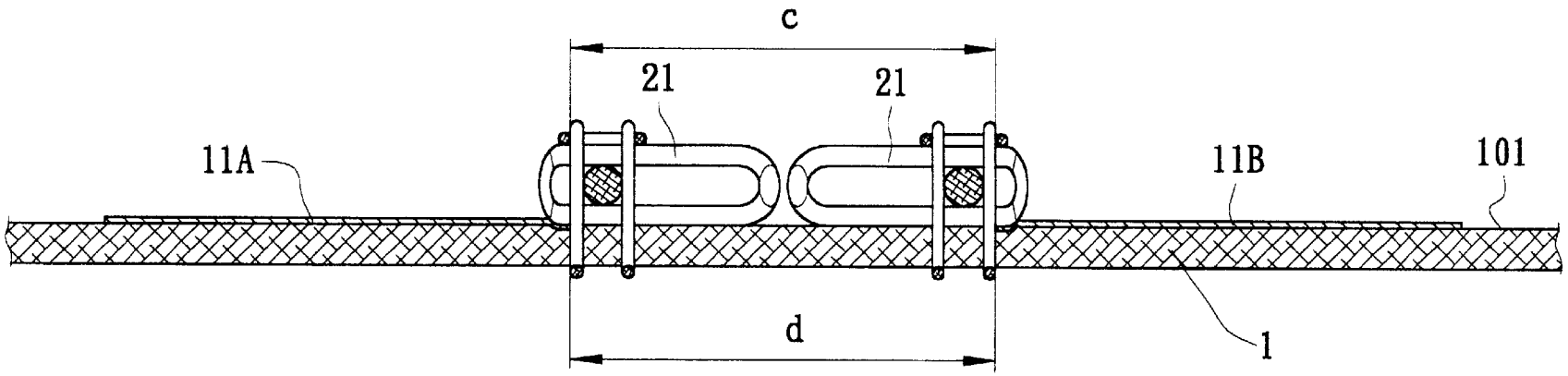
FIG. 3 is a schematic view showing that the cloth strip of the present invention is sewn with two banks of chain wheels.

The finished cloth strip 1 is sent to a strip sewing machine. Two banks of continuous chain teeth 21 press against one another and then are sewn to the front surface 101 of the cloth strip 1. The width c at the sewing portion of two banks of chain teeth 21 is equal to the distance d between the two halves 11A and 11B of the label 11, as shown in FIG. 3.

Step 3: Expanding the chain teeth.

Figure 4:
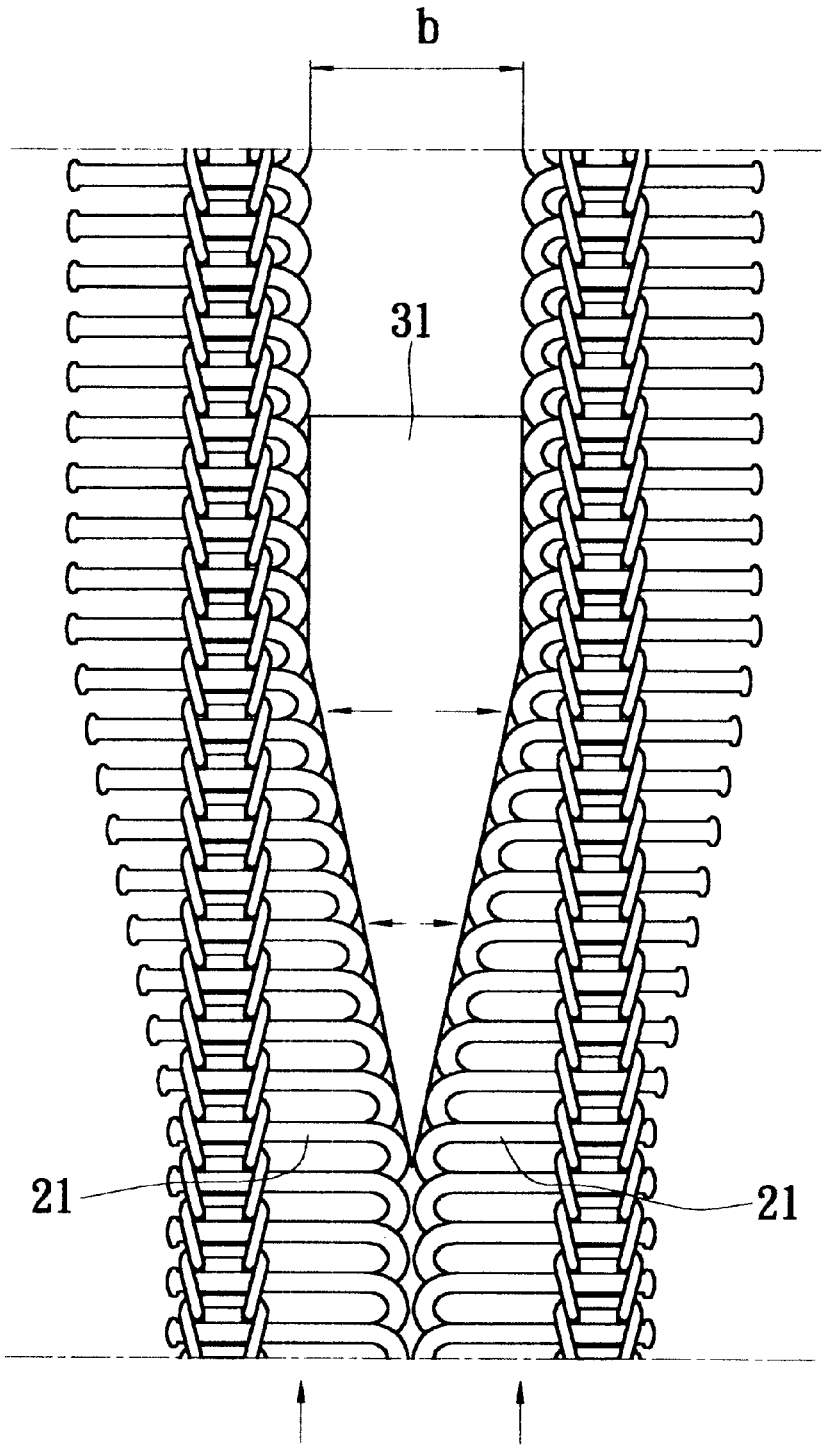
FIG. 4 is a schematic view showing the wedge block of the press wheel of the present invention being expanded.

The cloth strips 1 sewn with chain teeth 21 are sent to a wedge. A wedge block 31 in the wedge expands the two banks of the chain teeth 21 outwards, so that a space b is formed between the two banks of chain teeth 21, as shown in FIG. 4.

Step 4: Cutting the spacing

Figure 5:
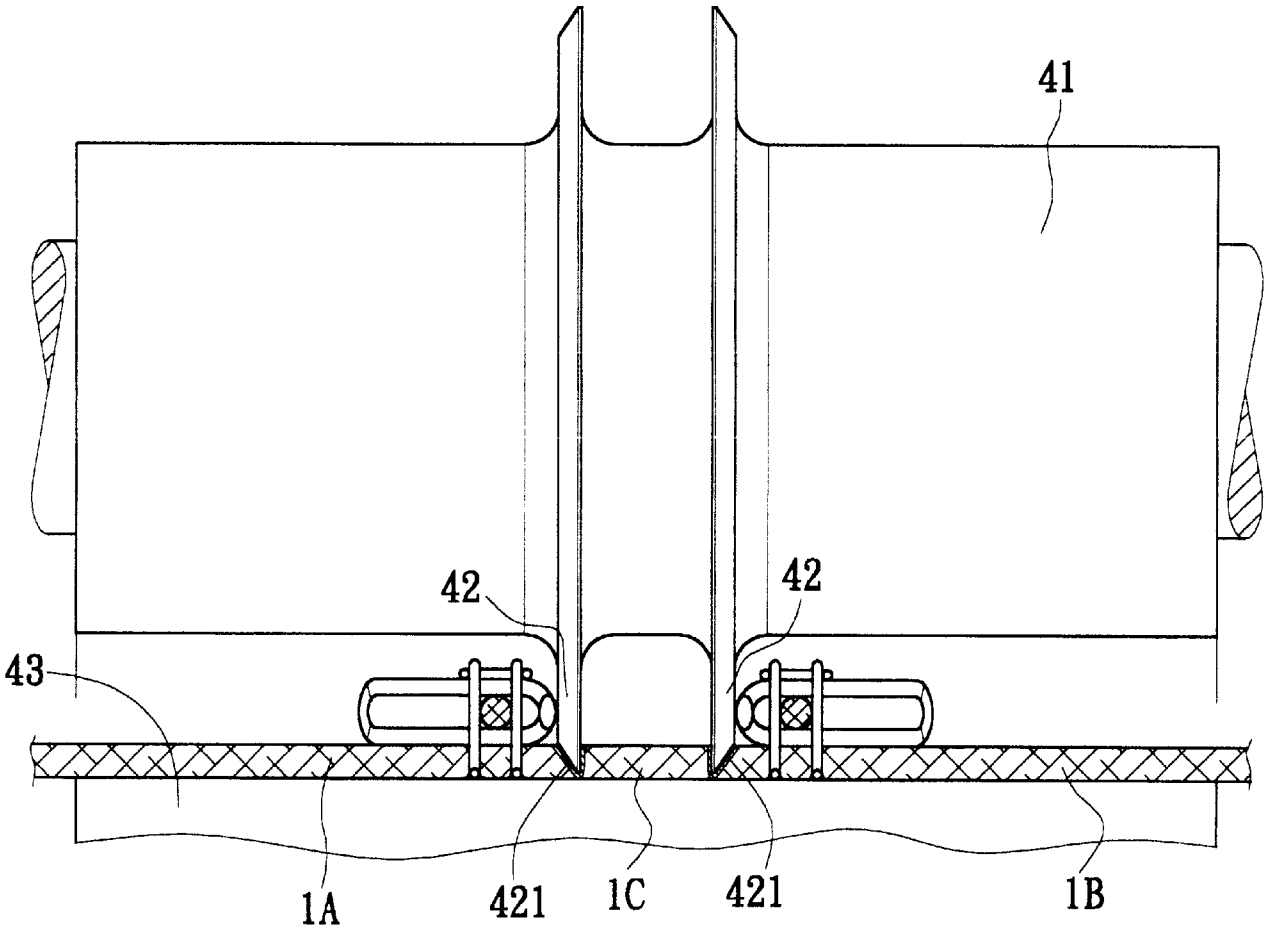
FIG. 5 is a schematic view showing two cutting portions of the press wheel of the present invention pressing into the cloth strip.
Figure 6:
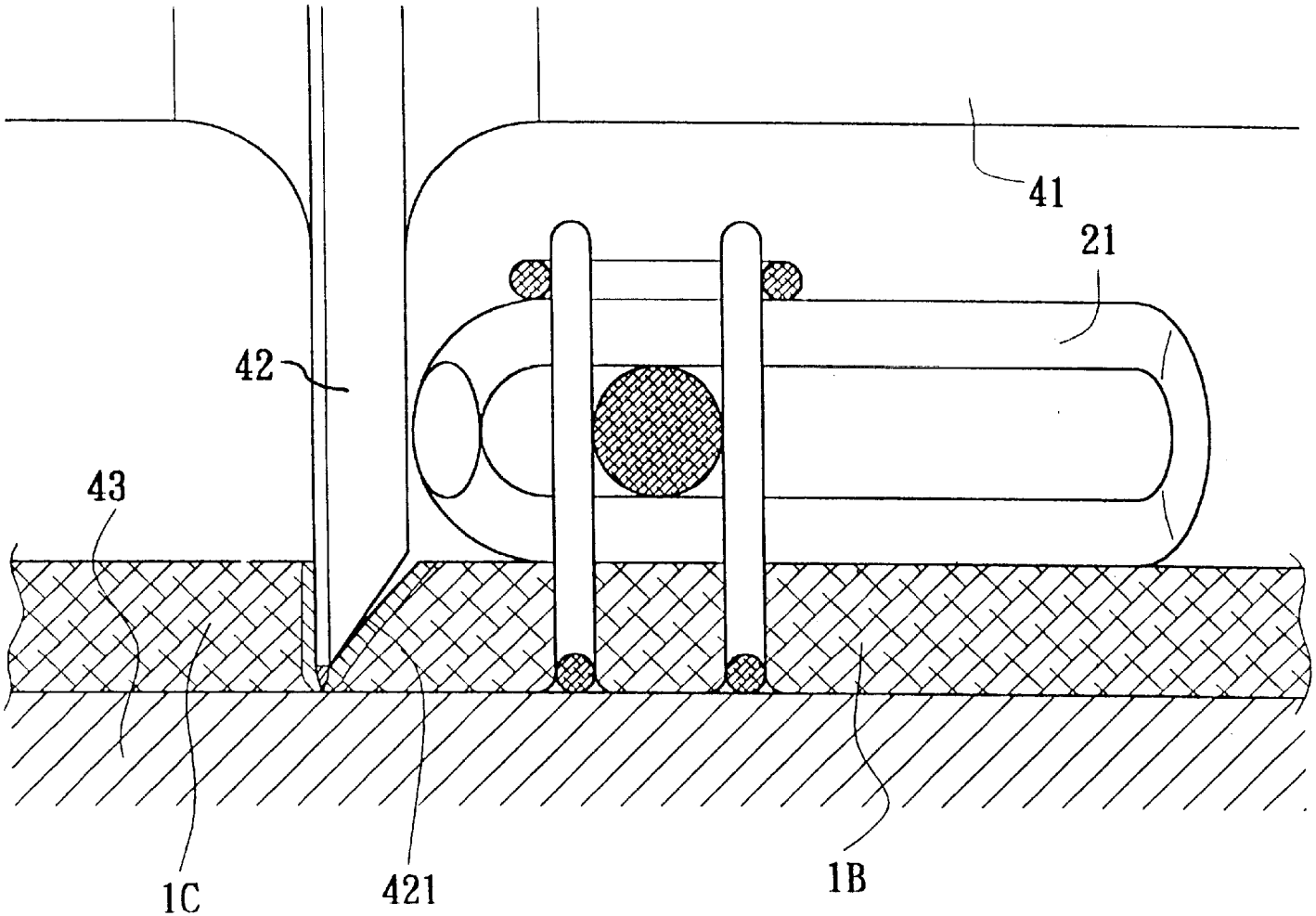
FIG. 6 is a schematic view showing one of the cutting portions of the press wheel of the present invention pressing into the cloth strip for melting and cutting it.

After the chain teeth 21 are expanded, the cloth strip 1 is sent to a supersonic cutter. The press wheel 41 of the supersonic cutter has two cutting portions 42 positioned with respect to the spacing b of the two banks of chain teeth 21. The outer sides of two cutting portions 42 have inclined surfaces 421. The two cutting portions 42 press into the cloth strip 1 to pass to the supersonic vibrating table 43, as shown in FIG. 5. Thereby, the cloth strip 1 can be melted and cut by supersonic waves so that the cloth strip 1 is cut adjacent to the two banks of chain teeth 21 with a spacing b therebetween, so that a left and a right portion 1A, 1B and a middle residue portion 1C are formed. As the cloth strip 1 is melted and cut by, supersonic waves, the inclined portion 421 presses against the cloth strip 1 as illustrated in FIG. 6. Thereby, the edges of the left kind right portions 1A and 1B of the cut cloth strip 1 are well sealed.

Step 5: Separating the strips

Figure 7:
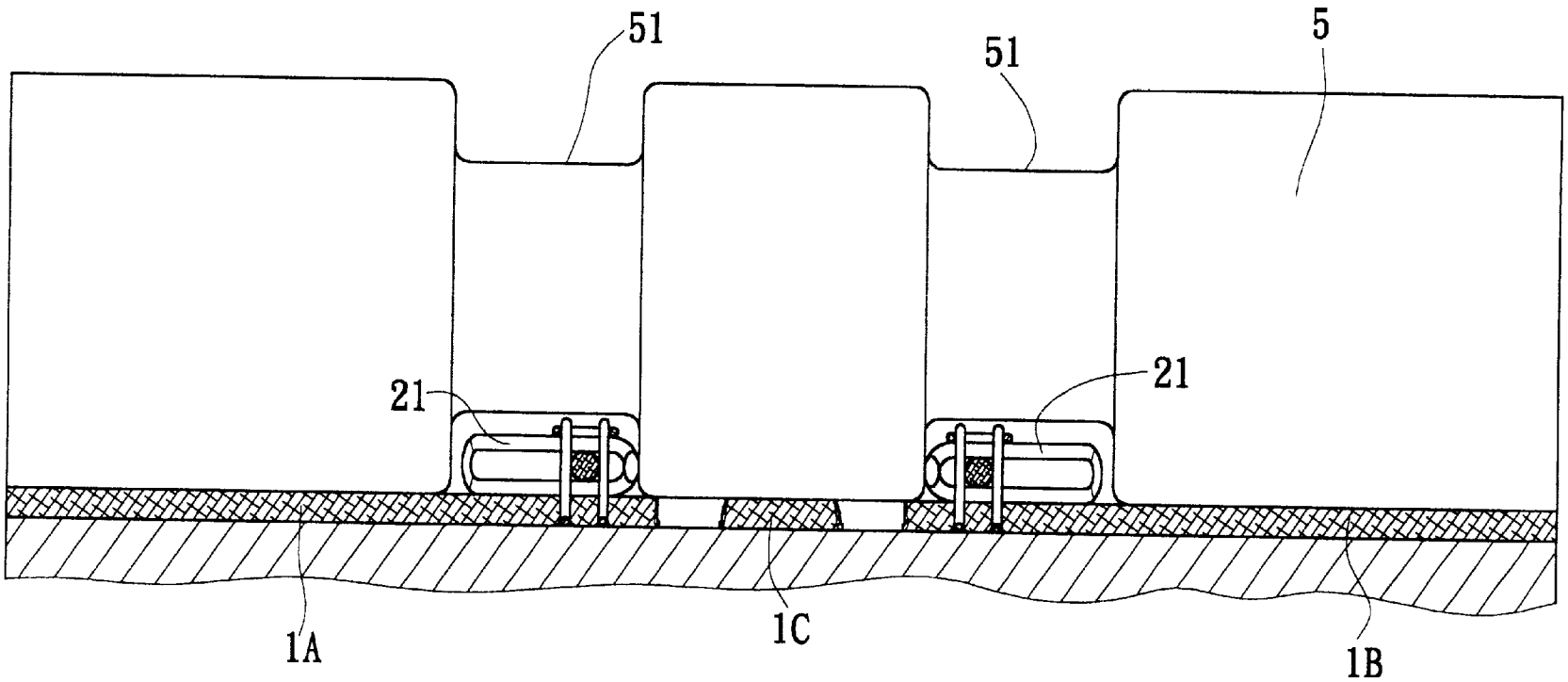
FIG. 7 is a schematic view showing the strip separation wheel of the present invention pressing on the cloth strip.

The cut cloth strip 1 is sent to a strip separation wheel 5. The strip separation wheel 5 has two receiving grooves 51 in correspondence with the two banks of chain teeth 21, so that the strip separation wheel 5 will not press against the two banks of chain teeth 21. Only the pressed cloth strip 1 is displaced by the strip separation wheel, as illustrated in FIG. 7. The output side of the strip separation wheel 5 has a collector (not shown) that pulls out the residue cloth c at the middle portion of the cloth strip 1. Thus, the strip separation wheel 5 will feed out the left and right portions 1A and 1B of the cloth strip 1 sewn with chain teeth 21 at the same time.

Step 6: Fittings

Figure 8:
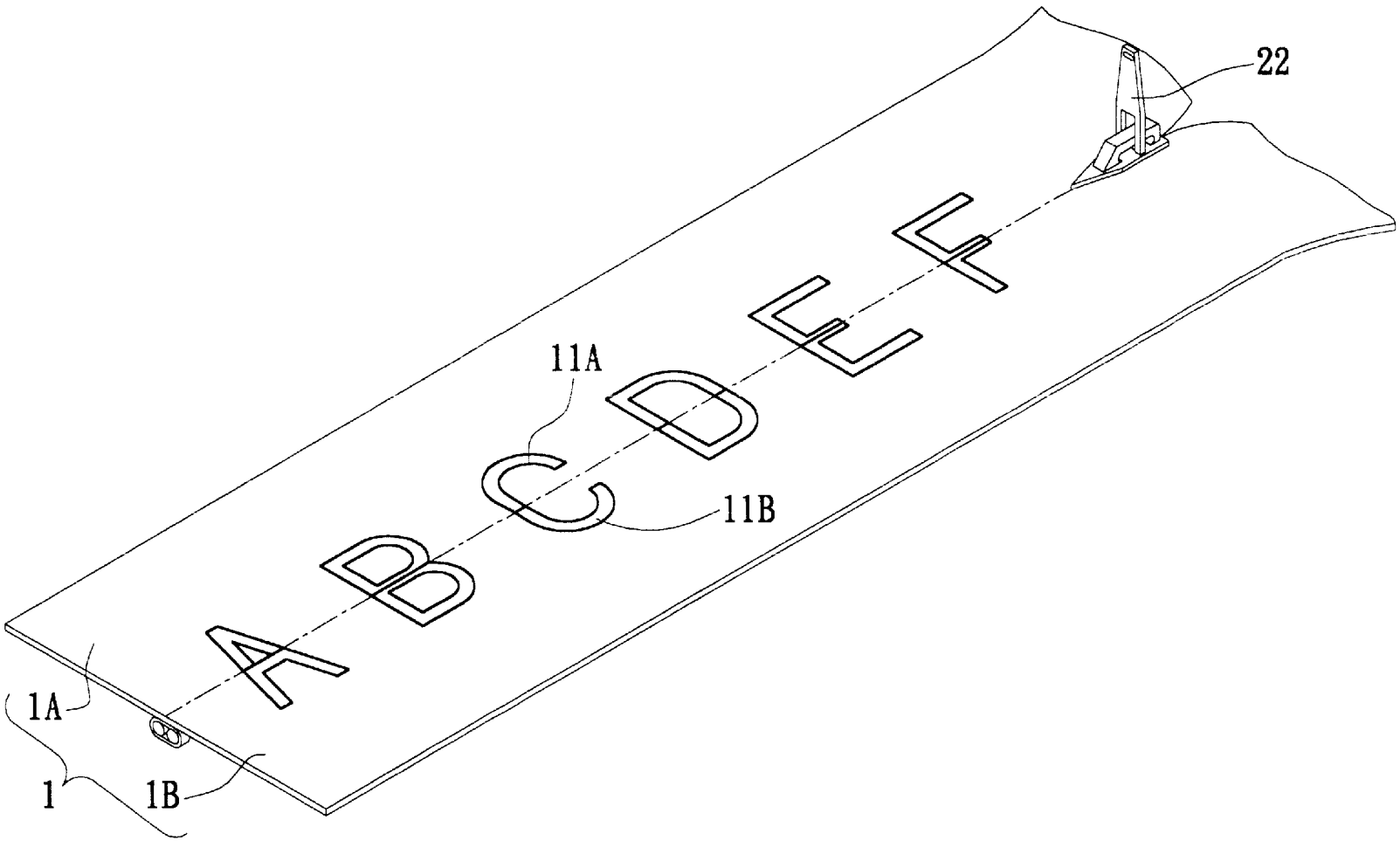
FIG. 8 shows a complete zipper.

The chain teeth 21 on the left and right portions 1A and 1B of the cloth strip 1 fed out by the strip separation wheel 5 are turned over (chain teeth 21 facing down) so that the indicated two halves 11A and 11B press together. Then a fitting, such as a chain clip 22, is attached thereto. As a result, a zipper is finished, as shown in FIG. 8.

Since the pattern or character label 11 is divided into two parts which are spaced with a distance d and are made on the same cloth strip 1, when sewing the chain teeth 21, the work required for aligning and correction are unnecessary, and no error occurs in the registration of the two halves 11A and 11B. Furthermore, since the width c between the sewn portions of two banks of chain teeth 21 is equal to the distance d between the two halves 11A and 11B of the label 11, then, when the left and right portions with the chain teeth 21 are turned over, the two halves 11A and 11B are closely registered, and no error in connection occurs. Moreover, the two cutting portions 42 of press wheel 41 of the supersonic cutter have an inclined surface 421 pressing into the left and right portions 1A and 1B. The edges of the left and right portions are sealed by high temperature melting and cutting.

In summary, in the zipper of the present invention, the two halves 11A and 11B of the label 11 can be closely combined without needing to be aligned. When the cloth strip is cut by supersonic waves, the edges are melted and sealed at the same time.

From the description of the present invention it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A method for manufacturing a zipper comprising the steps of:

dividing a predetermined pattern or character label into two halves, the two halves being spaced by a first predetermined distance and formed on a front surface of a cloth strip;

sending the cloth strip to a strip sewing machine, two banks of continuous chain teeth being pressed against one another and then sewn to the front surface of the cloth strip, the sewn portions of the two banks of chain teeth having a second predetermined distance therebetween, the second predetermined distance being equal to the first predetermined distance;

sending the cloth strips sewn with chain teeth to a wedge, a wedge block in the wedge expanding the two banks of the chain teeth outwards to form a space between the two banks of chain teeth;

sending the cloth strip with spaced banks of chain teeth to a supersonic cutter, the supersonic cutter having a press wheel with two cutting portions at positions corresponding to the space between the two banks of chain teeth, the two cutting portions pressing against the cloth strip to pass to a supersonic vibrating table, wherein the cloth strip is melted and cut by supersonic waves so that the cloth strip is respectively cut adjacent to the two banks of chain teeth with a spacing therebetween to form a left portion, a right portion and a middle residue portion;

sending the cut cloth strip to a strip separation wheel, the strip separation wheel having two receiving grooves respectively disposed in correspondence with the two banks of chain teeth so that the strip separation wheel will not press against the two banks of chain teeth, the strip separation wheel pressing only the cloth strip to displace the cloth strip toward an output side thereof, the output side of the strip separation wheel having a collector (or pulling the middle residue cloth from the cloth strip and thereby feed the left and right portions respectively sewn with the banks of chain teeth at the same time; and turning over the chain teeth and the left and right portions of the cloth strip to face the back surfaces thereof, pressing the two halves of the label against one another, and adding a fitting to the banks of chain teeth to complete the zipper.

2. The method for manufacturing a zipper as claimed in claim 1, wherein the two cutting portions of the press wheel of the supersonic cutter each has an inclined surface respectively pressing against the left and right portions as the cloth strip that is melted and cut by supersonic waves, the cut edges being sealed by a high temperature.

* * * * *